United States Patent [19]

McKenna

[11] 4,450,850

[45] May 29, 1984

[54] CRUTCH FOR USE ON AN ICY SURFACE

[76] Inventor: William A. McKenna, 2925 Sunset Dr., Bellingham, Wash. 98225

[21] Appl. No.: 373,607

[22] Filed: Apr. 30, 1982

[51] Int. Cl.[3] ..... A61H 3/02

[52] U.S. Cl. ..... 135/78

[58] Field of Search ..... 135/77, 78, 79, 80, 135/81, 65, 66, 84, 86; 272/70, 70.1, 70.2, 70.3, 70.4; 182/107, 108, 109, 111, 134, 200, 202, 203, 204, 205

[56] References Cited

U.S. PATENT DOCUMENTS

| | | | |
|---|---|---|---|
| 1,304,978 | 5/1919 | Herrold | 135/80 X |
| 1,314,000 | 8/1919 | Lansky, Jr. | 135/80 |
| 1,383,156 | 6/1921 | Sherman | 135/79 X |
| 1,431,068 | 10/1922 | Waney | 182/109 |
| 1,523,703 | 1/1921 | Morfitt | 135/80 |
| 2,230,406 | 2/1941 | Johnson | 135/77 |
| 3,646,949 | 3/1972 | Streeter | 135/80 |

FOREIGN PATENT DOCUMENTS

| | | | |
|---|---|---|---|
| 903527 | 8/1962 | United Kingdom | 182/108 |

*Primary Examiner*—Robert A. Hafer
*Assistant Examiner*—Arnold W. Kramer
*Attorney, Agent, or Firm*—Hughes, Barnard & Cassidy

[57] ABSTRACT

A conventional crutch having a ground engaging blunted tip member adapted to frictionally engage a finished ground surface. A second ground engaging member having a sharp tip adapted to be stuck into an icy surface is fixedly attached to and spaced from the crutch member. In one position, with the crutch assembly slanting downwardly and outwardly from the person, the point of the second member is above the ground surface. However, by rotating the crutch assembly 180 degrees from the first position, the point of the second member comes into ground engagement to firmly engage an icy surface. The blunted tip is compressible and the sharp tip is disposed slightly above the bottom of the compressible blunted tip when the crutch is disposed vertically with no weight applied thereto.

4 Claims, 7 Drawing Figures

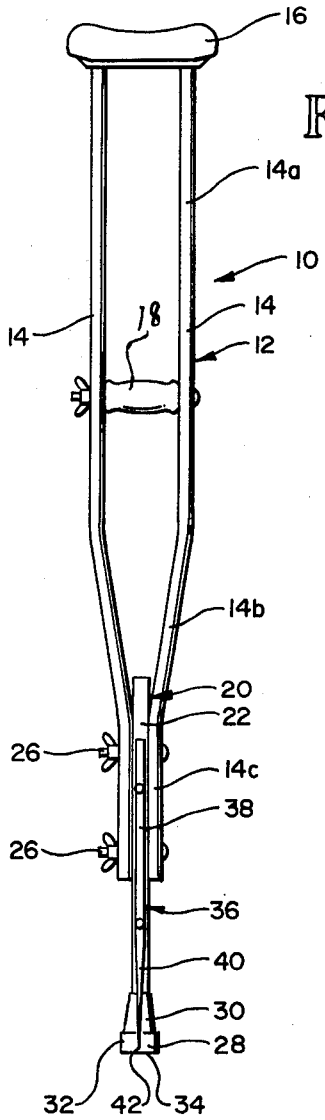
FIG. 1
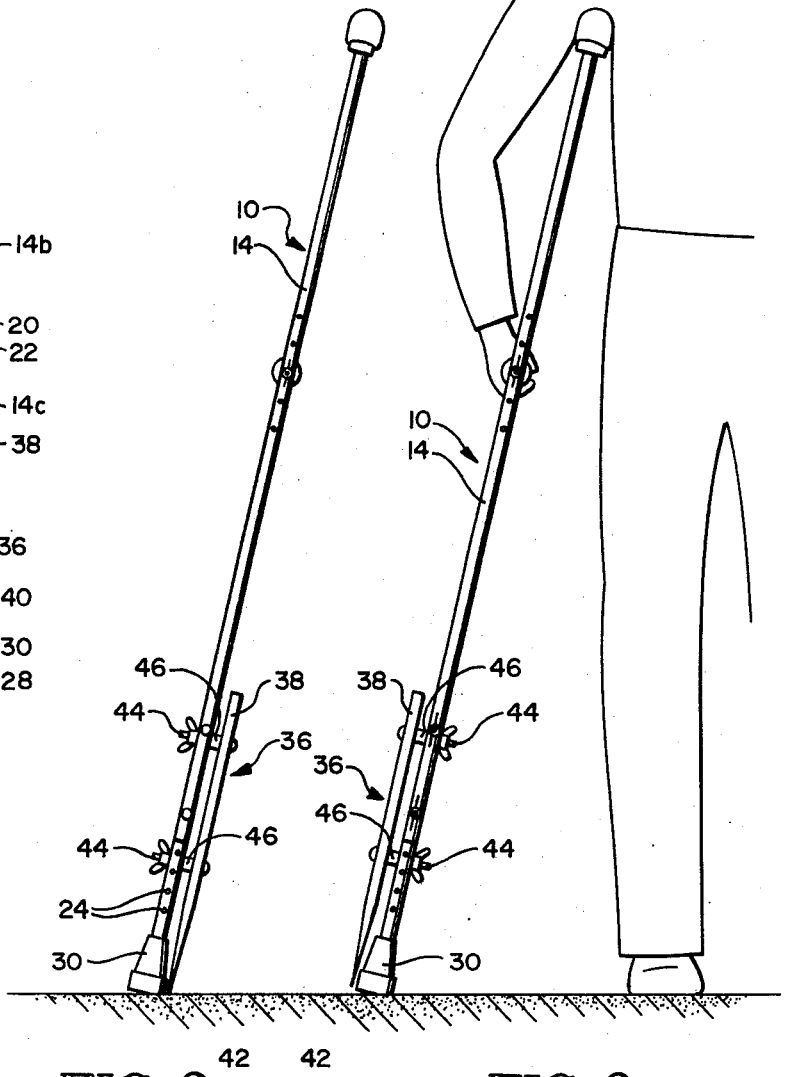
FIG. 2
FIG. 3

CRUTCH FOR USE ON AN ICY SURFACE

BACKGROUND OF THE INVENTION

The present invention relates to a crutch assembly particularly adapted for use both on a finished ground surface and also on an icy surface.

When a person with an injured leg is using a pair of crutches, the crutches are normally placed under each arm, and moved forwardly to engage the ground surface. Quite commonly the person manipulating the crutches will have the ground engaging tips of the crutches spaced outwardly in a sidewise direction a moderate extent for greater stability, so that the two crutches slant from the person downwardly and outwardly. The ground engaging tips of the crutches are normally made of a moderately yielding rubber-like material which has a relatively high co-efficient of friction to provide firm frictional engagement, and also which yields moderately so that the impact of the crutch against a ground surface is cushioned to some extent.

However, a conventional pair of crutches must be used with a good deal of caution on an icy surface, where the frictional engagment of the crutch tips is minimal. For this reason, there have been attempts in the prior art to furnish crutches with spike-like or pointed members which are sufficiently sharp to dig into an icy surface and thus provide for firm ground engagement.

One example of such a crutch is shown in U.S. Pat. No. 1,314,000 (Lansky, Jr.). There is a metal plate 10 having a ground engaging edge, which may or may not be serrated. The plate can be located in two positions. In one position, the plate has the ground engaging tip pointing upwardly along the side of the crutch to be totally out of ground engagement. In a second position, the metal clip is rotated 180 degrees so that it is moderately below the existing ground engaging tip so that it firmly engages the underlying surface. Thus, when the person desires to use the crutches on a slippery surface, it is necessary to first change the position of the plates to the ground engaging position. A quite similar device is shown in U.S. Pat. No. 1,523,703 (Morfitt).

The problem with such crutch arrangements is that the sharp points would, if used on a finished surface, damage the finished surface. Also, if such sharp points or edges are used on a hard surface, such as a cement sidewalk, the point or edge would soon become blunted and lose some of its effectiveness in digging into and firmly engaging an icy surface. Thus, there is the necessity of changing the sharp ground engaging members from one position to the other, depending on whether or not the person is over an icy surface or some other surface.

In U.S. Pat. No. 2,230,406 (Johnson), there is shown a crutch that has a sharp ground engaging member which can be used on ice. In this patent, it is recognized that quite commonly the crutch is used in a manner to be sloping downwardly and outwardly from the person to engage the ground. Accordingly, the sharp ground engaging member (which is adapted to engage an icy surface) is positioned at an annular slot in the lower portion of the flexible tip of the crutch. When the crutch is turned one way, the flexible tip bears down on the sharp member to yieldingly press it into engagement with the icy surface. However, when the crutch is rotated 180 degrees to a second position, the sharp point is on the outside of the crutch and is thus lifted away from ground engagement. Thus, the crutch can be used on both an icy surface and on a regular surface, simply by rotating the crutch 180 degrees along its longitudinal axis.

The crutch of the Johnson patent does remedy the problem of having to move the ground engaging tip to a different position on the crutch each time the crutch is to be used on ice. However, the configuration of the tip is such that the loading on the crutch is shared between the sharp tip and the blunt ground engaging surface in a manner that the loading carried by the blunt ground engaging surface increases with greater force being exerted on the crutch. Thus, the full benefit of the sharp ice engaging tip is not realized in the crutch of the Johnson patent.

Another approach for movement on an icy surface is shown in U.S. Pat. No. 2,005,507 (Russell et al), which shows a cane having a pair of ground engaging sharp tips. The lower end of the cane is fastened to the person's leg, and the sharp tips prevent the person's foot from slipping.

In view of the foregoing, it is an object of the present invention to provide a quite convenient crutch which, without adjustment, can be used either on a conventional surface or on an icy surface, with the crutch providing firm ground engagement particularly on the icy surface.

SUMMARY OF THE INVENTION

The crutch assembly of the present invention is particularly adapted for use on an icy surface, as well as on a finished ground surface. This assembly comprises a crutch member having a longitudinal axis and also having an upper gripping portion adapted to be held by a person in a first position and in a second position where the crutch member is rotated approximately 180° about a longitudinal axis relative to the first position. The crutch member in the first and second positions extends downwardly in a slant away from the person, with the longitudinal axis being at a slanted angle to the ground surface within a predetermined angular range. The crutch member has a first side which faces toward the person with the crutch member in the first position, and a second side which faces toward the person with the crutch member in the second position.

There is a first ground engaging member mounted to the lower end of the crutch member and having a blunted ground engaging surface adapted to frictionally engage a finished ground surface. There is a second ground engaging member having a ground engaging tip adapted to engage an icy surface. This second member is firmly attached to the crutch member so as to have a substantially fixed position relative to the crutch member. The second ground engaging member is positioned with its tip on the second side of the crutch member relative to the ground engaging surface of the first ground engaging member. The tip is at a level relative to the ground engaging surface of the first ground engaging member so that with the crutch member in its first position, the tip is out of contact with the ground surface, and with the crutch member in the second position, the tip comes into contact with the ground engaging surface.

Thus, the crutch assembly can be used in the first position without the tip digging into the ground surface, and on any icy surface the crutch assembly can be used in the second position so that the tip firmly engages the icy surface to prevent slippage.

More particularly, the first ground engaging member has a first surface portion that comes into initial ground engagement with the ground surface when the crutch member is in the first position. The first surface portion is positioned at a first plane perpendicular to the longitudinal axis and is compressible through a first distance to a second plane also perpendicular to the longitudinal axis. The tip of the second ground engaging member is positioned above a third plane perpendicular to the longitudinal axis, with the third plane being below the second plane by a distance equal to the cotangent of the slanted angle times a lateral distance from the first surface portion to the tip of the second ground engaging member.

The tip of the second ground engaging member is located relative to the second surface portion so that after at most only moderate compression of the second surface portion against a ground surface, the tip is in contact with the ground surface.

Other features will become apparent from the following detailed description.

BRIEF DESCRIPTION OF THE DRAWINGS

FIG. 1 is a side elevational view of the crutch assembly of the present invention;

FIG. 2 is a front view of the crutch, shown in its position to engage an icy surface;

FIG. 3 is a view similar to FIG. 2, showing a person holding the same crutch assembly in a ground engaging position for use on a finished ground surface or on a paved surface;

DESCRIPTION OF THE PREFERRED EMBODIMENT

Figure 4:
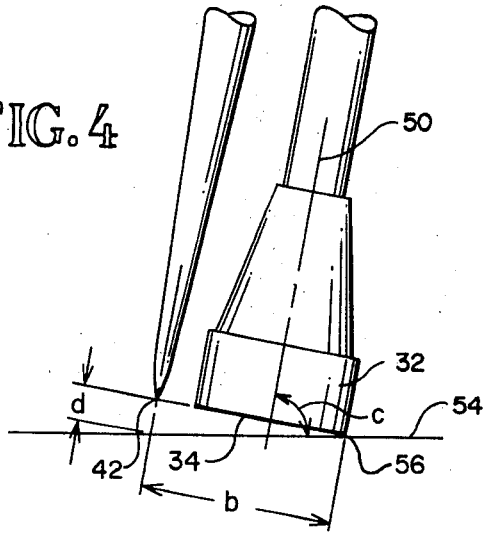
FIG. 4 is an enlarged view of the ground engaging portion of the crutch assembly in the position shown in FIG. 3, where the ground engaging end portion is about to engage the ground surface.

The crutch assembly of the present invention is generally designated 10, and comprises a main crutch member 12 which is or may be of conventional configuration. As shown herein, this crutch member 12 comprises two elongate rod-like members 14, each of which has an upper portion 14*a*, an intermediate portion 14*b*, and a lower portion 14*c*. At their upper portions, the two rod members 14 are spaced moderately from one another having at their upper ends an upper support pad 16 that fits under the person's arm. Connected between the two rod-like members 14 a little above the mid height of the crutch is a hand grip 18. Below the hand grip 18, the two intermediate rod portions 14*b* converge to the point where the two lower rod portions 14*c* join to a lower ground engaging member 20.

The ground engaging member 20 comprises an elongate cylindrical leg portion 22 which fits between the two lower portions of the rod-like members 14. The leg portion 22 has a plurality of holes 24 at vertically spaced locations along its length so that it can be positioned at different vertical locations between the rod portions 14*c*, thus making the crutch member 12 longer or shorter. A pair of thumb screws 26 are inserted through two sets of matching holes in the two lower rod portions 14*c* and through a selected pair of holes 24 in the leg 22 to hold the leg portion 22 rigidly to the rod members 14.

Mounted to the lower end of the leg portion 22 is a ground engaging member 28, which is or may be of conventional design. Desirably this member 28 is made of a rubber-like material which has a relatively high co-efficient of friction and which yields moderately to provide a certain amount of cushioning when the crutch member 12 is placed against a ground surface. As shown herein, the ground engaging member 28 comprises an upper sleeve portion 30 that grips the lower cylindrical side wall of the leg portion 22, and a lower portion in the form of a pad 32 that is formed integrally with the sleeve portion 30 and has a lower ground engaging surface 34. The pad portion 32 is sufficiently thick in its vertical dimension so that it will yield moderately when it is pressed against a ground surface.

The components 12 through 34 described above currently exist in a typical prior art crutch. One of the benefits of the present invention is that it can readily be adapted to such a conventional crutch to form the combination of the present invention.

To describe now that portion of the combination of the present invention that is not shown in the prior art, there is a second ground engaging member 36 that comprises an elongate upper cylindrical mounting portion 38 and a lower portion 40 which terminates in a relatively sharp tip 42. The ground engaging member 36 can conveniently be provided in the form of the lower end of a ski pole that has the basket portion removed from the ski pole. The mounting portion 38 is fixedly attached to the leg portion 22, this being accomplished by forming the mounting portion 38 and the leg portion 22 with two pairs of matching holes and inserting thumb screws 44 through the two pairs of matching holes. The mounting portion 38 of the second ground engaging member 36 is spaced from the leg portion 22 a short distance by a pair of spacing collars 46 positioned around the thumb screws between the leg portion 22 and the mounting portion 38. This is done in a manner so that the lower sharp tip 42 is precisly positioned relative to the pad portion 32 of the ground engaging member 28. This will be described more precisely hereinafter with reference to FIGS. 4 through 7.

To indicate generally the functioning of the present invention, reference is made to FIG. 3 which shows a person 48 holding the crutch assembly 10 in the position which it would normally be held for use on a conventional surface (i.e. either a finished floor, an outdoor paved surface, etc.). It will be noted that the longitudinal axis 50 of the crutch member 12 extends from the person's shoulder 52 downwardly and outwardly away from the person at a moderate slope from the vertical. In this first position, the second ground engaging member 36 is positioned on the outside of the crutch member 12 (i.e. on the side of the crutch member 12 that is facing away from the person 48).

FIG. 2 shows the crutch assembly 10 in a second position where it has been rotated 180 degrees about its longitudinal axis 50. In the position of FIG. 2, the second ground engaging member 36 is positioned on the inside of the crutch assembly 10, and when the crutch assembly 12 is located in the usual position of use where it is at a moderate slant to the vertical, the tip 42 of the second ground engaging member 36 is able to come into firm contact with the ground surface 54. The crutch assembly 10 is placed in the position of FIG. 2 when it is to be used on an icy surface.

To explain the operation of the present invention more completely, reference is now made to FIG. 4 which shows the lower ground engaging portion of the crutch assembly 10 in the position of FIG. 3.

Let it be assumed that the person 48 is using a pair of crutch assemblies 10, one under each arm in the position shown in FIG. 3, and further that the person has swung the two crutch assemblies 10 forwardly, with the ground engaging pad 32 just beginning to come into contact with the ground surface 54. Since the ground engaging surface 34 has a generally planar configuration perpendicular to the longitudinal axis 50, with the crutch assembly 10 being slanted moderately off the vertical, the inside edge portion 56 of the surface 32 initially comes into engagement with the ground surface 54.

As more pressure is placed on the crutch assembly 10, the pad 32 becomes compressed, with the lower surface 34 being made to conform with the ground surface 54. As the pad 32 is compressed further downwardly, the bearing surface portion of the surface 34 increases to increase the force exerted by the pad 32, and the pressure exerted by the portion of the surface 34 already in contact with the ground 54 increases because of the increased amount of compression, to further increase the force exerted by the pad 32. Finally, when the pad 32 is compressed approximately to the position shown in FIG. 5, the person's weight is fully supported on the two crutch assemblies 10.

Figure 5:
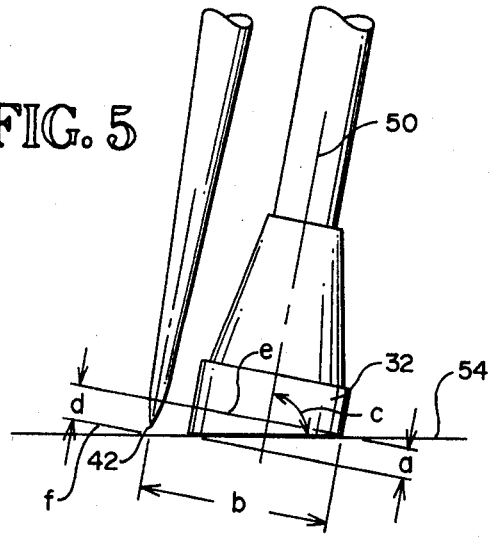
FIG. 5 is a view similar to FIG. 4, but showing the tip portion of the crutch assembly after the full weight of the person has been placed upon the crutch.

As indicated previously, the positioning of the tip 42 of the second ground engaging member 36 relative to the pad 32, is critical. Let it be assumed that from the position of FIG. 4 to the position of FIG. 5, the initial ground engaging surface portion 56 is compressed by a distance indicated at "a" as shown in FIG. 5. The lateral distance (i.e. that distance measured perpendicular to the longitudinal axis 50) from the initial ground engaging portion 56 to the tip 42 is indicated at "b" in both FIGS. 4 and 5. The angle which the longitudinal axis 50 of the crutch assembly 10 makes with the ground surface 54, where the crutch assembly 10 is slanted in its normal position of use, is indicated at "c" in both FIGS. 4 and 5. Next, there is determined a distance below the plane of the surface 34 in its normal position, which distance is equal to the distance "b" multiplied by the co-tangent of the angle "c", this distance being indicated at "d" in FIG. 4. To determine the lower limit of the vertical location of the tip 42 relative to the plane of the surface 34, first the plane "e" is located relative to the plane of the surface 34 in its normal position, this plane "e" being above the normal plane of the surface 34 by the distance "a". Next, a plane "f" is located below the plane "e" by a distance equal to the length "d". The tip 42 should be located vertically above the plane "f". In FIG. 5, the tip 42 is positioned sufficiently far above the plane "f" so that it is actually a moderate distance above the surface 54. However, if the person using the crutches decreases the slant of the longitudinal axis of the crutch assemblies 10 so that the distance "d" decreases, then the plane "f" would be closer to (and possibly just above) the plane of the surface 34 in its non-compressed position, and in this situation the extra margin for the location of the tip 42 becomes necessary.

Figure 6:
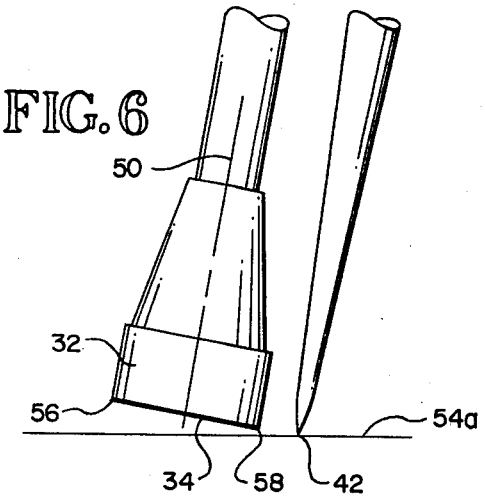
FIG. 6 is a view similar to FIG. 4, but showing the lower ground engaging portion of the crutch assembly where it is just beginning to engage the ground surface.
Figure 7:
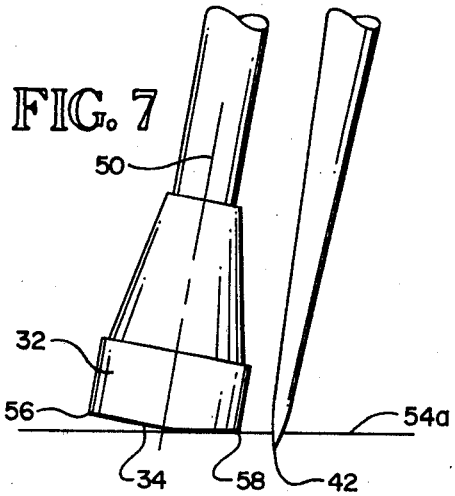
FIG. 7 is a view similar to FIG. 6, but showing the lower portion of the crutch assembly after the person has placed full weight on the crutch assembly.

However, the tip 42 should not be placed very far above the ground engaging surface 34 and this is explained with reference to FIGS. 6 and 7. In FIGS. 6 and 7 the ground surface 54 is indicated at 54*a* to indicate that this surface is an icy surface. In the position of FIG. 6, the opposite side of the ground engaging surface 34 comes into engagement with the ground surface 54 at location 58. Since the tip 42 is much closer to the edge 58 than it is to the edge 56, and with the tip 42 being positioned just a short distance above the plane of the ground engaging surface 34, in the position of FIG. 6, the tip 42 is very close to the ground surface 34. Thus, when only a quite moderate downward force is exerted on the crutch assembly 10, the tip 42 immediately comes into engagement with the ground surface 54.

When the edge portion 58 is only slightly compressed, the tip 42 begins to dig into the icy surface 54*a*. As greater downward force is exerted on the crutch assembly 10, substantially all the loading is exerted through the tip 42 into the icy surface 54*a*. Since there is very little additional compression of the ground engaging pad 34, the tip 42 is able to engage the surface 54*a* with sufficient force to become implanted therein and prevent slippage. Also, since the second ground engaging member 36 is rigidly attached to the crutch leg 22, there is no rotation of the tip 42. Rather, the tip 42 maintains its angle of attack to keep its firm engagement with the icy surface.

I claim:

1. A crutch assembly particularly adapted for use on an icy surface, as well as on a finished ground surface, said assembly comprising:

a. a crutch member having a longitudinal axis and also having an upper gripping portion adapted to be held by a person in a first position and in a second position where the crutch member is rotated approximately 180° about the longitudinal axis relative to the first position, said crutch member in said first and second positions extending downwardly at a slant away from the person with the longitudinal axis being at a slanted angle to the ground surface within a predetermined angular range, said crutch member having a first side which faces toward the person with the crutch member in the first position and a second side which faces toward the person with the crutch member in the second position;

b. a first ground engaging member mounted to the lower end of the crutch member and having a blunted ground engaging surface adapted to frictionally engage a finished ground surface;

c. a second ground engaging member having a ground engaging tip adapted to engage an icy surface, said second ground engaging member being firmly attached to said crutch member so as to have a substantially fixed position relative to said crutch member;

d. said second ground engaging member being positioned with its tip on the second side of the crutch member relative to the ground engaging surface of the first ground engaging member, said tip being at a level relative to the ground engaging surface of the first ground engaging member so that with the crutch member in its first position, the tip is out of contact with the ground surface and with the crutch member in the second position, the tip comes into contact with the ground engaging surface;

e. said first ground engaging member having a first surface portion that comes into initial ground engagement with the ground surface when the crutch member is in the first position, said first surface portion being positioned at a first plane perpendicular to said longitudinal axis and being compressible through a first distance to a second plane also perpendicular to the longitudinal axis, the tip of the second ground engaging member being positioned above a third plane perpendicular to the longitudinal axis, the third plane being below the secnd plane by a distance equal to the cotangent of the slanted angle times a lateral distance from the first surface portion to the tip of the second ground engaging member; whereby the crutch assembly can be used in the first position without the tip digging into the ground surface, and on any icy surface the crutch assembly can be used in the second position so that the tip firmly engages the icy surface to prevent slippage.

2. The crutch assembly as recited in claim 1, wherein the ground engaging surface of the first ground engaging member has a second surface portion which is adjacent the ground surface when the crutch member is in its second position, the tip of the second ground engaging member being located relative to said second surface portion so that after at most only moderate compression of said second surface portion against ground surface, the tip is in contact with the ground surface.

3. The crutch assembly as recited in claim 1, wherein said crutch member comprises an upper crutch portion having a shoulder engaging portion and a hand engaging portion, and a lower leg portion fixedly attached to the upper crutch portion, said second ground engaging member comprising an elongate mounting portion rigidly connected to the leg portion, with the tip of the second ground engaging member being positioned closely adjacent to and at an elevation higher than the ground engaging surface of the first ground engaging member.

4. The crutch assembly as recited in claim 3, wherein said leg portion is mounted to the upper crutch member portion so as to be vertically adjustable relative to the upper crutch member portion, the second ground engaging member being fixedly connected to said leg portion at at least two vertically spaced locations.

* * * * *